US006088978A

United States Patent [19]

Satterwhite

[11] Patent Number: 6,088,978

[45] Date of Patent: Jul. 18, 2000

[54] PANEL CONNECTION SYSTEM

[75] Inventor: James R. Satterwhite, Cedarburg, Wis.

[73] Assignee: Super Sky Products, Inc., Mequon, Wis.

[21] Appl. No.: 09/152,658

[22] Filed: Sep. 14, 1998

[51] Int. Cl.[7] ..... E04B 7/16

[52] U.S. Cl. ..... 52/200; 52/204.5; 52/204.62; 52/204.7; 52/204.67

[58] Field of Search ..... 52/200, 204.5, 52/204.62, 235, 730.3, 72, 236.3, 393, 394, 395, 204.7, 204.67

[56] References Cited

U.S. PATENT DOCUMENTS

| | | | |
|---|---|---|---|
| 3,138,230 | 6/1964 | Puto | 52/204.5 |
| 4,117,638 | 10/1978 | Kidd, Jr. et al. . | |
| 4,573,300 | 3/1986 | Bezner . | |
| 4,680,905 | 7/1987 | Rockar | 52/200 |
| 4,738,065 | 4/1988 | Crandell | 52/235 |
| 4,850,167 | 7/1989 | Beard et al. . | |
| 5,163,257 | 11/1992 | Crowell . | |
| 5,216,855 | 6/1993 | Richter et al. . | |
| 5,343,660 | 9/1994 | Caoduro et al. | 52/200 X |
| 5,369,924 | 12/1994 | Neudorf | 52/200 X |
| 5,435,106 | 7/1995 | Garries et al. | 52/204.5 |
| 5,797,225 | 8/1998 | Ishikawa | 52/93.1 |
| 5,913,786 | 6/1999 | Mayer | 52/204.7 |

*Primary Examiner*—Carl D. Friedman
*Assistant Examiner*—Phi Dieu Tran A
*Attorney, Agent, or Firm*—Quarles & Brady LLP

[57] ABSTRACT

A panel connection system provides lateral expansion of panel members in a skylight and vertical glazing arrangement while at the same time affording a secure connection. In a preferred embodiment, the connecting members provide a slidable seal arrangement so as to substantially reduce entry by the elements. The connecting system is readily adapted to be used in conjunction with various types of support systems for the skylight and vertical glazing arrangements.

16 Claims, 8 Drawing Sheets

PANEL CONNECTION SYSTEM

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention relates to a connecting system for structural panels. More particularly, it relates to a connecting device for assembling skylight and vertical glazing panels composed of a polycarbonate material.

Polycarbonate plastic has become the material of choice in constructing building structures where the admission of light is desirable. While polycarbonate has many desirable properties such as transparency and resiliency, it also has a high coefficient of expansion and contraction.

A connecting or glazing bar system for assembling polycarbonate panels is disclosed in U.S. Pat. No. 5,163,257. While this system allows for expansion of the polycarbonate panels 32,34 it does not afford a locking type connection between the panels and the glazing bars 48, 50. A somewhat similar glazing system is disclosed in U.S. Pat. No. 4,850,167.

A skylight assembly is illustrated in U.S. Pat. No. 4,117,638. A somewhat floating connection is stated to be afforded between the skylight panel 11 and the two suspension panels. An interlocking glazing construction is depicted in U.S. Pat. Nos. 5,216,855 and 4,573,300.

The prior art does not provide a glazing system which affords a movable connection between panels and a structural retaining member without the need of additional connecting means such as bolts, screws, etc. Neither does the prior art provide a one-piece movable connecting device for a structural glazing system which also includes a sealing feature.

Thus, the need exists for a simplified connection in a glazing system for constructing a skylight and vertical glazing.

SUMMARY OF THE INVENTION

In one aspect, the invention provides a connecting device for locking a panel to a structural retaining member, the structural retaining member having a channel therein. A body member is adapted to be attached to a panel, and an arm member extends from the body member.

A head member extends from the leg member opposite from the body member. The head member is constructed and arranged to fit within a channel of the structural retaining member and to be movable therein.

In a preferred embodiment the body member, arm member and head member are of a one-piece construction and the head member is umbrella shaped.

In another aspect, the invention provides a structural glazing system for mounting at least one panel in the structure. A first structural retaining member has a channel therein and a second structural retaining member has a locking channel therein. First and second connecting devices have a body member and an arm member extending from the body member. A head member extends from the leg member opposite from the body member. The body of the first connecting device is connected to one end of a panel with the head member constructed and arranged to fit within the channel of the first structural retaining member and to be movable therein. The body of the second connecting device is connected to an opposing end of the panel with the head member constructed and arranged to fit within the locking channel.

In still another aspect, the invention provides a structural glazing system for mounting four panels in the structure. A structural retaining member has first and second channels at one end and third and fourth channels at an opposing end. Four connecting devices have a body member, an arm member extending from the body member, and a head member extending from arm member opposite the body member. The body member of the connecting devices is separately connected to four panels. The head members of each connecting device is positioned in the channels of the structural retaining member.

The objects of the invention therefore include:

(a) providing a locking type yet movable connection in a glazing system for panel members;

(b) providing a locking type connection of the above type which is particularly suited for skylight and vertical glazing fabrication;

(c) providing a locking type connection of the above type wherein a connecting device is of a one-piece construction;

(d) providing a locking type connection of the above type wherein the connecting device includes a one-piece seal feature; and (e) providing a locking type connection of the above type which is particularly suited for polycarbonate panels.

These and still other objects and advantages of the invention will be apparent from the description which follows. In the detailed description below preferred embodiments of the invention will be described with reference to the accompanying drawings. These embodiments do not represent the full scope of the invention. Rather the invention may be employed in other embodiments. Reference should therefore be made to the claims herein for interpreting the full breadth of the invention.

DETAILED DESCRIPTION

Figure 1:
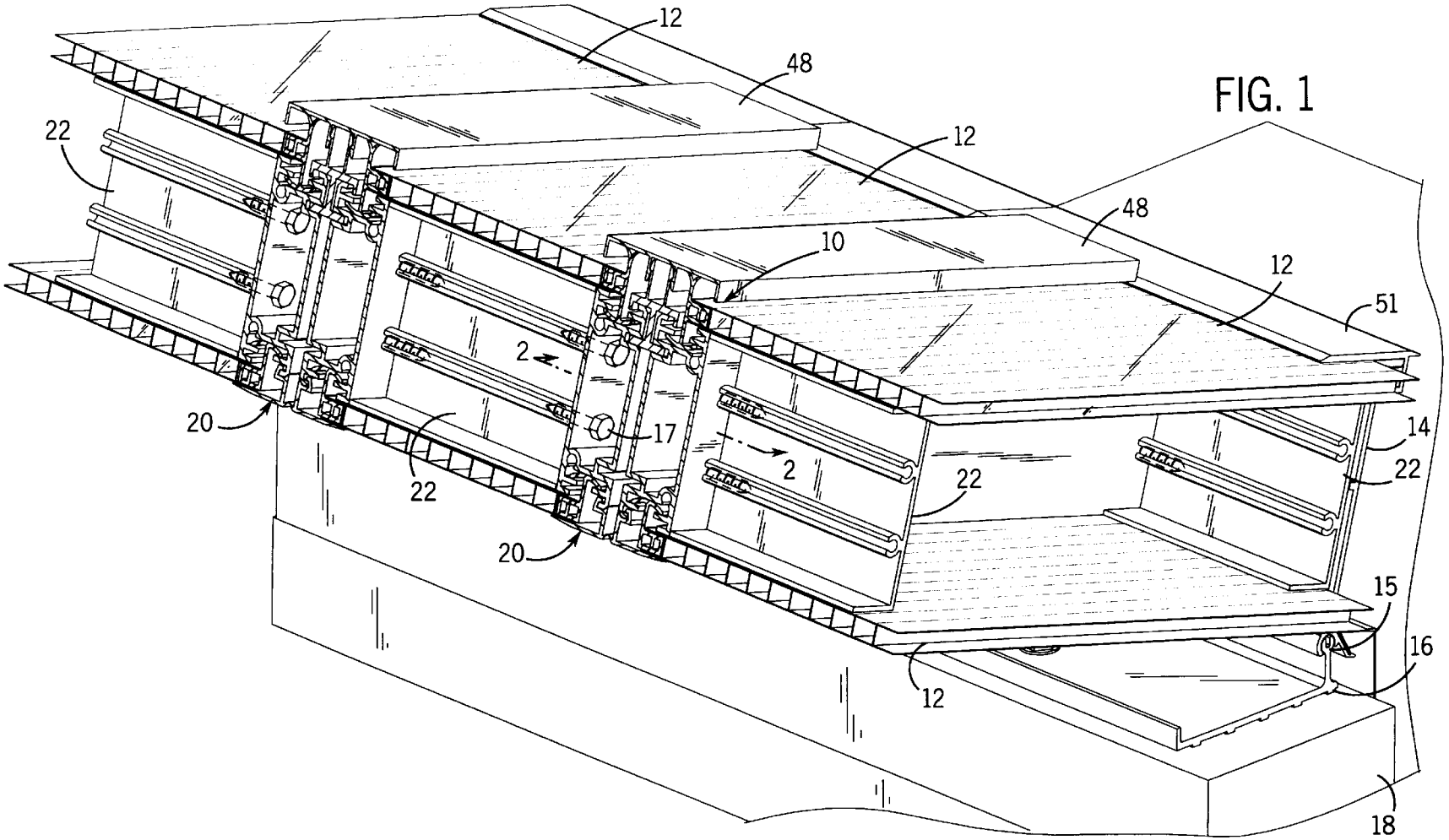
FIG. 1 is a perspective view illustrating a skylight structure a preferred embodiment with the connection system of this invention.
Figure 2:
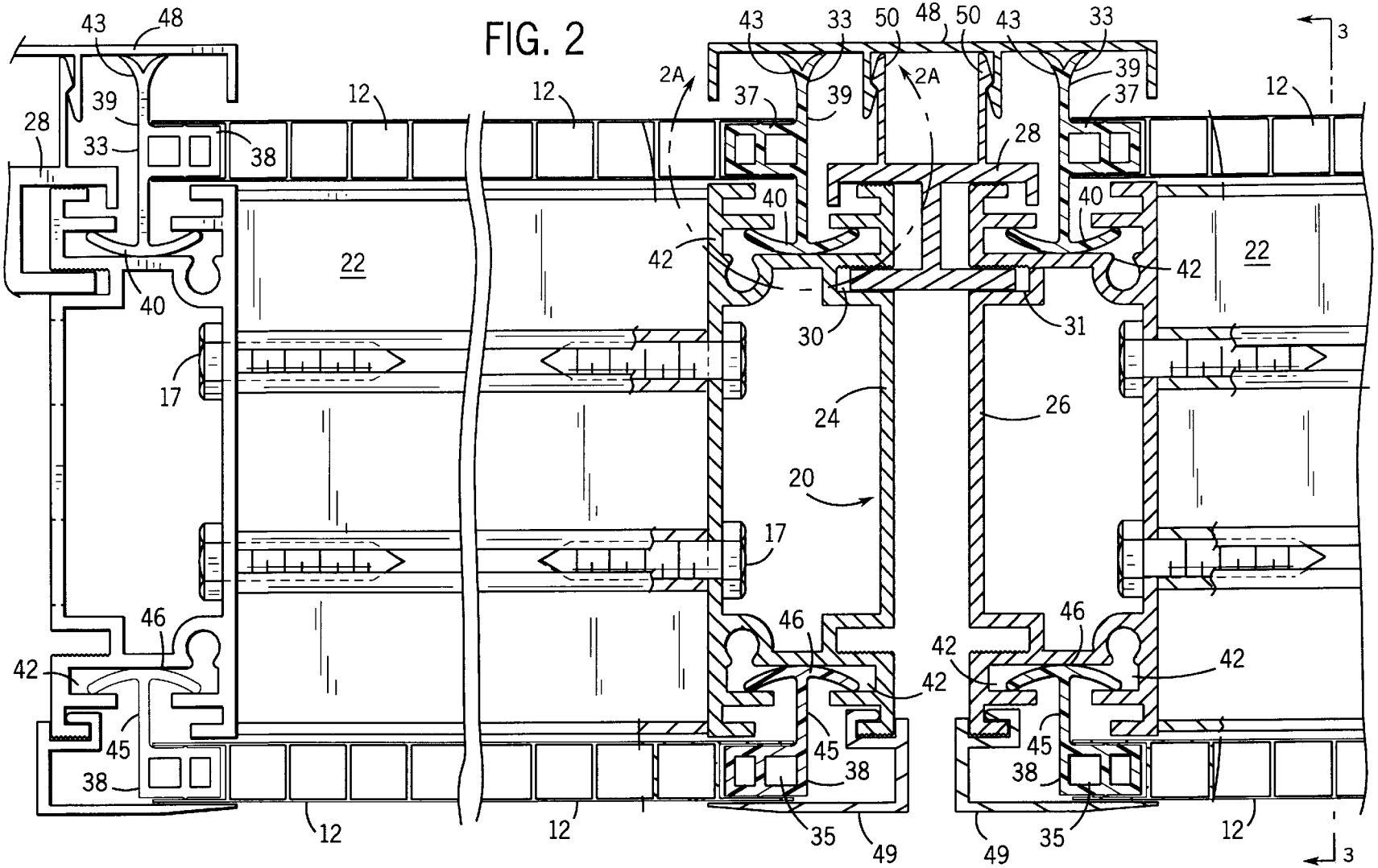
FIG. 2 a sectional view taken along line 2—2 of FIG. 1.
Figure 3:
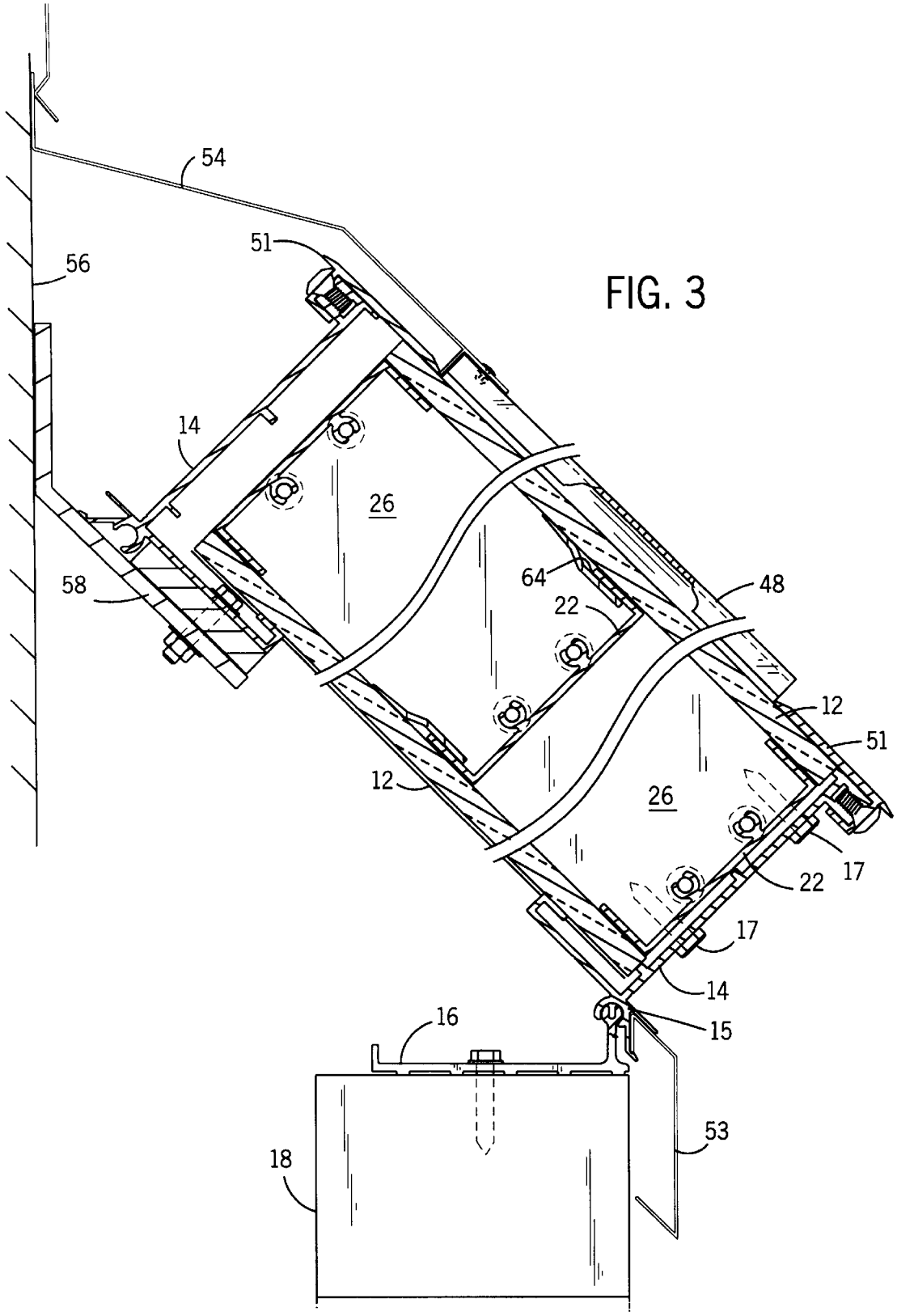
FIG. 3 is a side view taken along line 3—3 of FIG. 2 illustrating one method of connecting panel members of a skylight structure to a building.

Referring to FIGS. 1 and 3, there is shown a panel connection system, generally 10, for interconnecting glazing panels 12. The panels are supported by curb 14 which in turn pivotally connected to a curb base 16 by means of a ball and socket connection 15. The curb 14 is in turn supported by a building support 18. The panels 12 are supported by across bar members 22 which are connected to structural retaining members 20 such by the screws 17. This is best seen in FIG. 2.

As also seen in FIG. 2, the structural retaining members 20 include rafter support members 24 and 26 which are interconnected by a retainer 28. Grooves 30 and 31 are provided in the rafter support members 24 and 26 for receiving a portion of the retainer 28. There are connecting devices 33 and 35 which are composed of polycarbonate and secured to the ends of the polycarbonate panels 12 such as by ultrasonic welding. These connecting devices 33 and 35 have respective body members 37 and 38, as well as arm members 39 and 45 terminating in heads 40 and 46.

The head members 40 and 46 ride in channels 42 of the rafter support members 24 and 26. A cap 48 is joined to the retainer 28 by the interfitting flanged connection 50. Connecting devices 33 have foot members 43 extending from arm members 39 for sealing engagement with the cap 48. Closures 49 are also provided at the bottom of the support members 24 and 26.

Referring to FIG. 3, there is shown one means of attaching the skylight panels 12 to a support wall 56. Support bracket 58 extends from the wall 56 and is connected to a curb 14 upon which rests against the panel 12. A suitable flashing 54 is afforded between the wall 56 and the cap 48, extending over the top panel 51 of curb 14. There is also the flashing indicated at 53 extending between the building support 18 and the curb 14. It will be seen in FIG. 3 that the rafter support members 26 are secured to the curb such as by the screws 17. An intermediate panel retainer is also shown at 64.

Figure 2A:
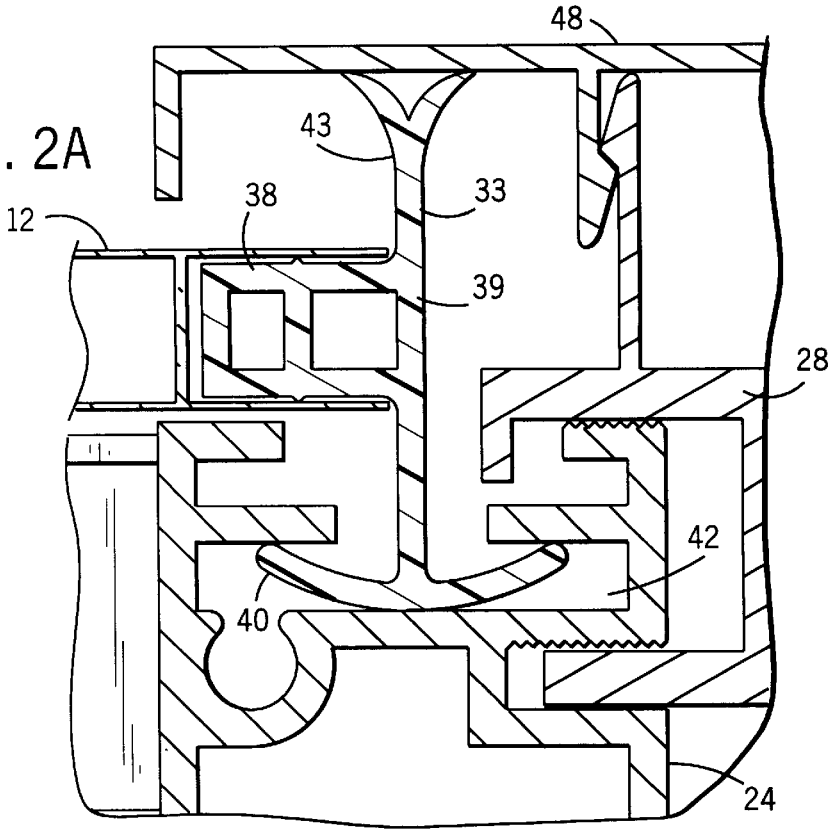
FIG. 2A is a sectional view taken along line 2A—2A of FIG. 2.
Figure 2B:
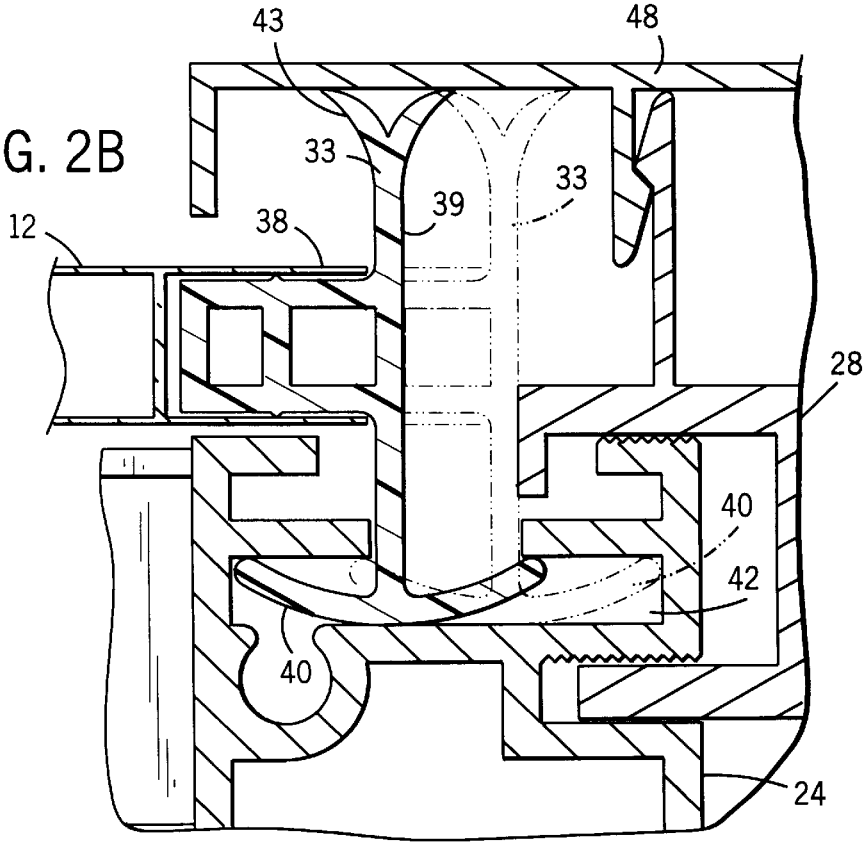
FIG. 2B is a view similar to FIG. 2A illustrating movement of a locking panel.

FIGS. 2A and 2B illustrate the movement of the connecting devices such as 33 in the channels 42 of the retainer 28. This is best seen by the broken line showing of connecting device 33 in FIG. 2B and illustrates the allowance for expansion and contraction of the panels 12.

Figure 4:
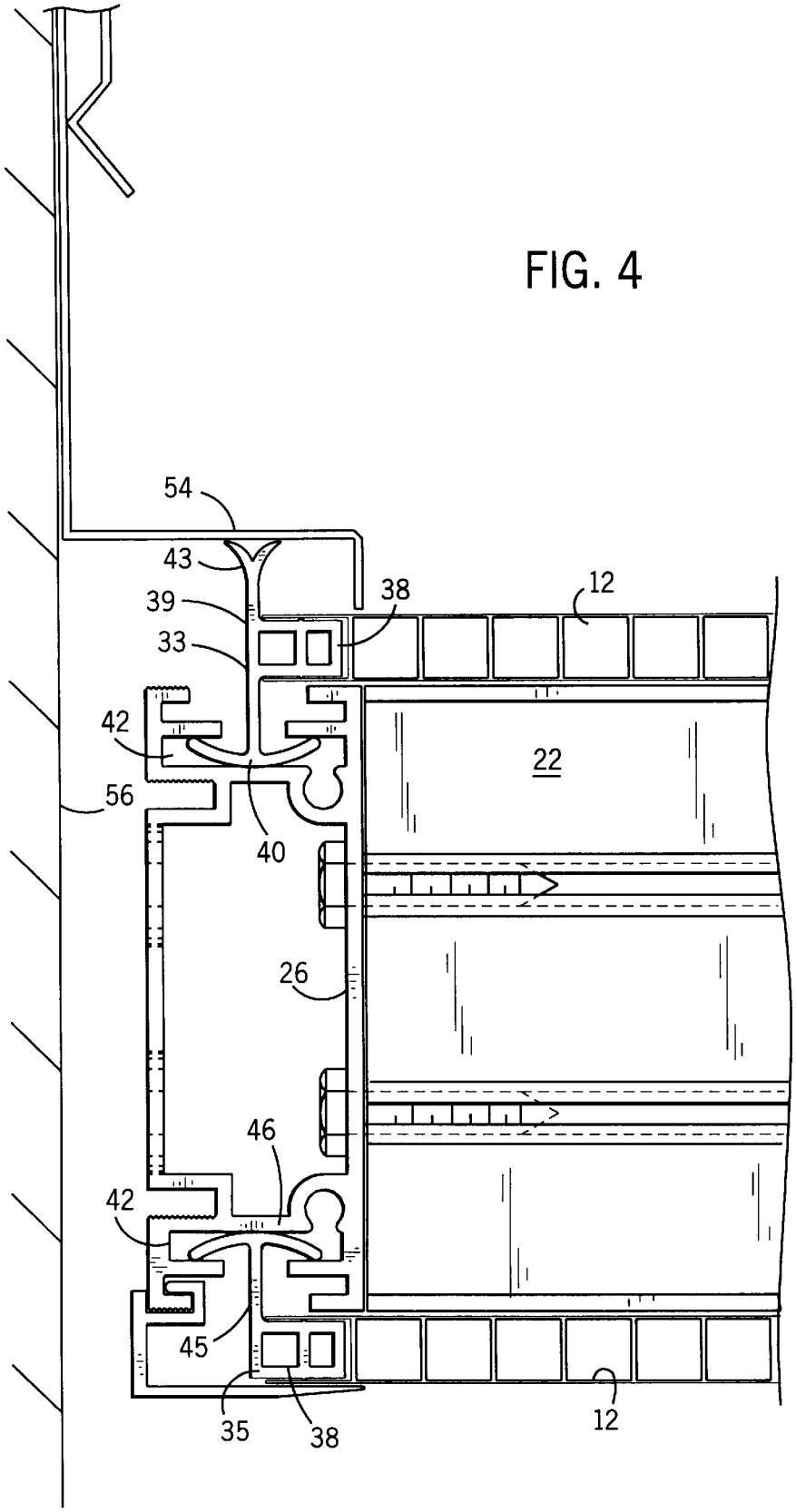
FIG. 4 is a view in side elevation illustrating another version of t panel connection system.

Referring to FIG. 4, there is shown another means of placing the panels 12 with the connecting devices 33 and 35 in the rafter support member 26 and with respect to the wall support 56. The flashing 54 extends from the wall 56 and is engaged in a sealing manner with the foot member 43 of the connecting device 33.

Figure 5:
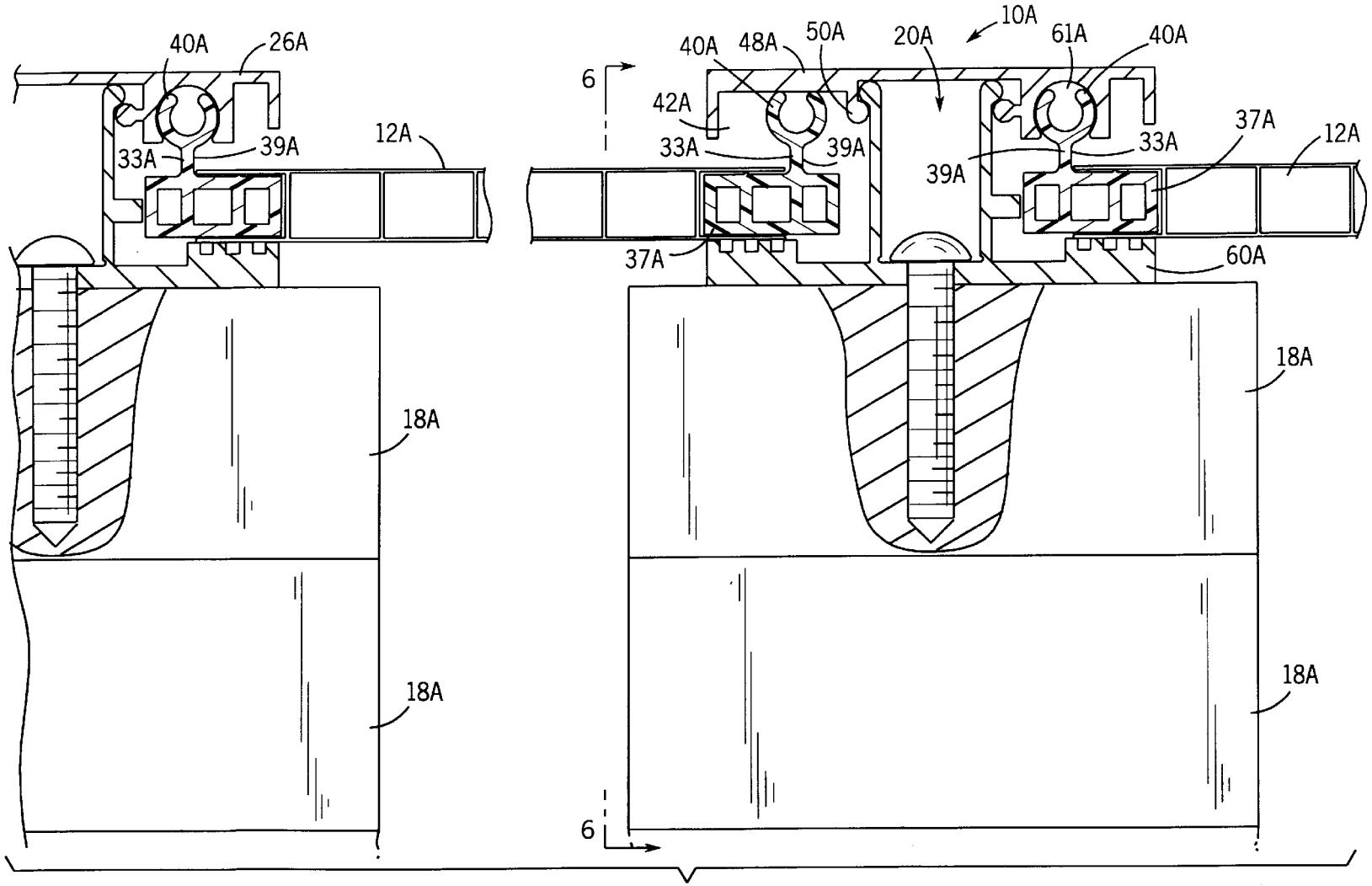
FIG. 5 is a view in elevation illustrating an alternative connection system cross-section.
Figure 6:
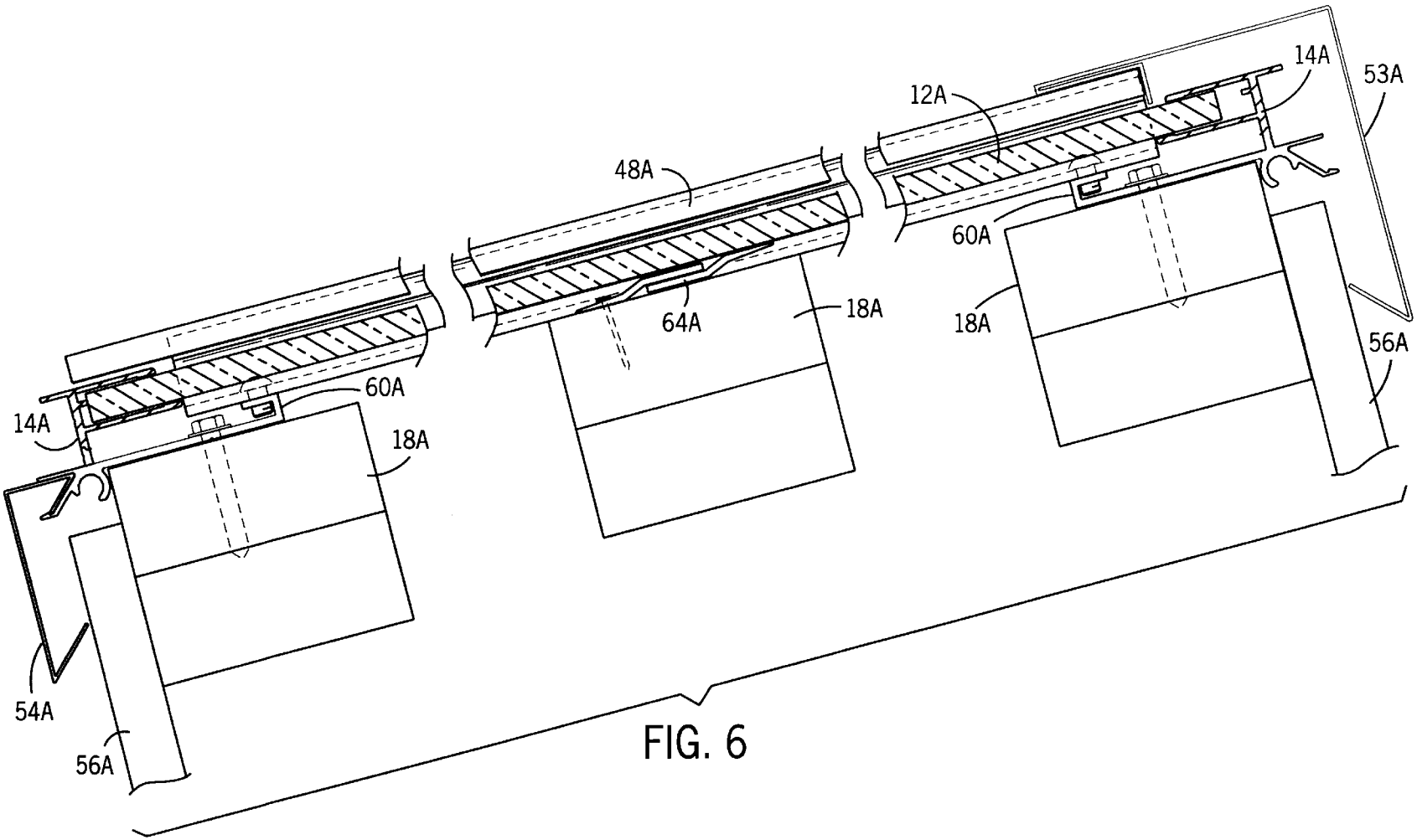
FIG. 6 is a sectional view taken along line 6—6 of FIG. 5.
Figure 7:
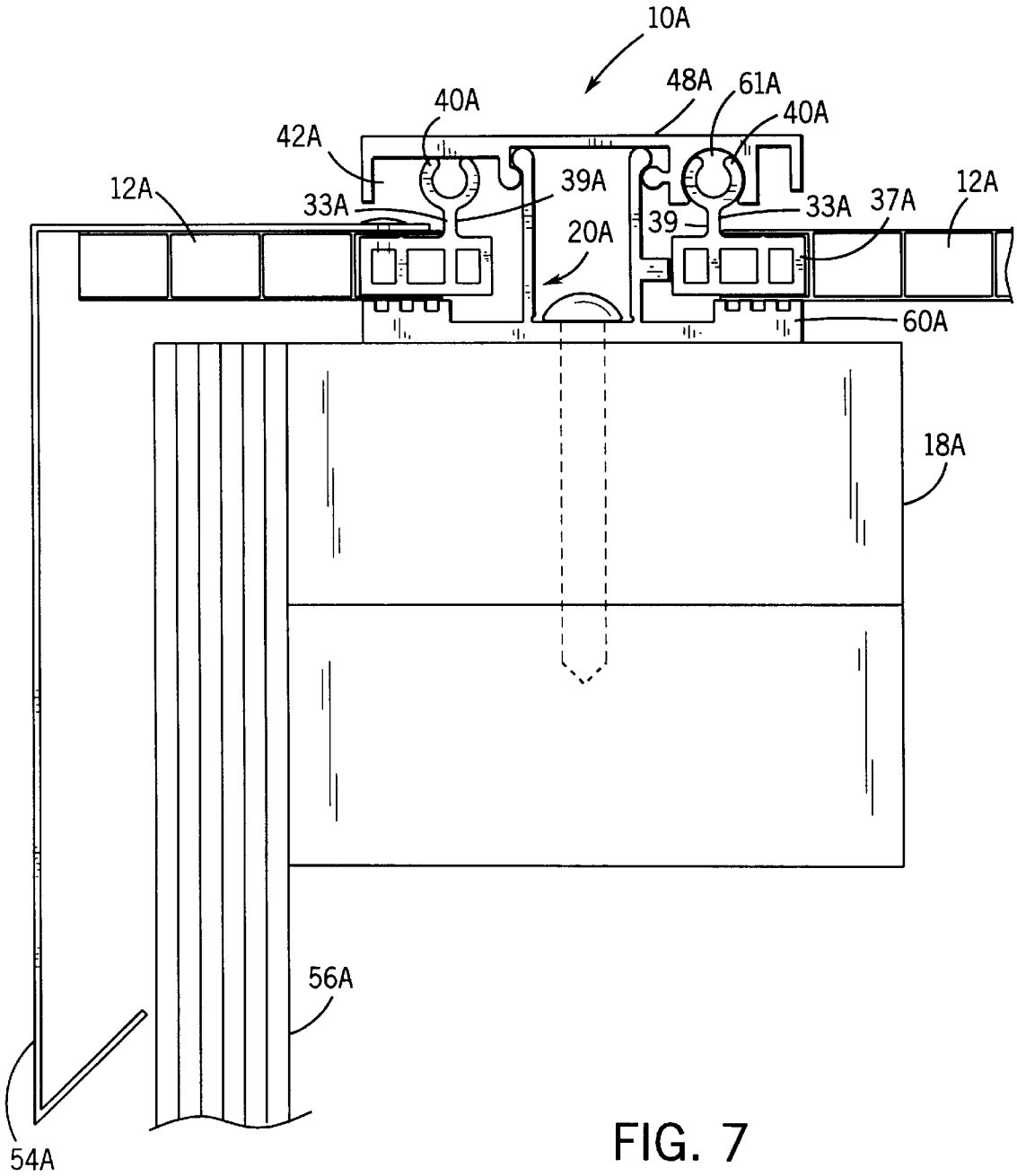
FIG. 7 a view similar to FIG. 5 showing another version of the alternative connection system.

FIGS. 5–7 show an alternative panel connection system 10A. Similar components are designated with the same numbers except with the suffix "A". The major difference between the two embodiments 10 and 10A is that the connecting device 33A has a head 40A which is locked into a grove 61A. This grove is provided in the cap 48A which is interconnected with a base member 60A of the retaining member 20A. In this particular version and by the connection of the connecting devices 33A with the panel 12A, one end of the panel is locked into the structural retaining member 20A while the opposite end is free to move such as with the head 40A in the channel 42A of the cap 48A.

FIGS. 6 and 7 illustrate different means of positioning the panels 12A in conjunction with the panel connection system 10A with respect to support walls 56A. As seen in FIG. 6, opposing curbs 14A are connected to building supports 18A with suitable flashing 54A and 53A provided between the curb 14A and the wall 56A in one instance and between the cap 48A and the wall 56A. As seen in this figure, the base member 60A of the structural retaining member 20A is connected to the curbs 14A. As also seen in this figure, there is an intermediate panel retainer 64A for supporting the panel 12A.

Referring to FIG. 7, this represents still another means of attachment of the panel connection system 10A with respect to the wall 56A. As shown, the flashing 54A is connected to the panel 12A and extends over the end of the wall 56A.

An important feature of the panel connection systems 10 and 10A described herein is the fact they can provide lateral and expansive movement of the polycarbonate panels 12 and 12A in a skylight arrangement. This is afforded by the movement of the heads of the connecting members such as 40 and 40A in the channels 42 and 42A of the respective structural retaining members 20 and 20A. Not only is expansive movement afforded but also a locking arrangement.

Another important feature is the elimination of additional attachment devices such as screws, at the point of connection of the connecting devices 33 and 33A to the retaining members 20 and 20A. Yet another important feature is the sealing engagement between the connecting device 33 and the cap 48.

Preferred embodiments have been described herein for the panel connection system. It is obvious that other alternative embodiments can be employed. For example, while the connecting devices 33, 33A and 35 and panels 12 are specifically described as being composed of polycarbonate other plastic materials could be employed such as acrylic, polyester or PVC or combinations thereof. If desired, glass could also be employed for the panels for use with the connecting devices and in the connection system. In addition, the structural retaining members 20 and 20A are preferably fabricated from aluminum. However, other materials could be employed such as polycarbonate, fiberglass or steel.

The foregoing invention can now be practiced by those skilled in the art. Such skilled persons will know that the invention is not necessarily restricted to the particular embodiments therein. The scope of the invention is to be defined by terms of the following claims as given meaning by the preceding description.

What is claimed is:

1. A structural panel system comprising:

a first retaining structure including a first retaining member at a first end of the first retaining structure and a second retaining member at an opposed second end of the first retaining structure, the first retaining member having a first channel and the second retaining member having a second channel;

a second retaining structure including a third retaining member at a first end of the second retaining structure and a fourth retaining member at an opposed second end of the second retaining structure, the third retaining member having a third channel and the fourth retaining member having a fourth channel, the second retaining structure being located adjacent the first retaining structure such that the third retaining member is located adjacent the second retaining member;

a first panel having a first connecting device connected to a first end of the first panel and a second connecting device connected to an opposed second end of the panel, the first connecting device having a first body member, a first arm member extending from the first body member, and a first head member extending from the first arm member opposite from the first body member, the first body member of the first connecting device being connected to the first end of the first panel, and the second connecting device having a second body member, a second arm member extending from the second body member, and a second head member extending from the second arm member opposite from the second body member, the second body member of the second connecting device being connected to the second end of the first panel, a second panel having a third connecting device connected to a first end of the second panel and a fourth connecting device connected to an opposed second end of the second panel, the third connecting device having a third body member, a third arm member extending from the third body member, and a third head member extending from the third arm member opposite from the third body member, the third body member of the third connecting device being connected to the first end of the second panel, and the fourth connecting device having a fourth body member, a fourth arm member extending from the fourth body member, and a fourth head member extending from the fourth arm member opposite from the fourth body member, the fourth body member of the fourth connecting device being connected to the second end of the second panel; and a cap mounted to the second retaining member and the third retaining member, wherein the first panel is disposed between the first retaining member and the second retaining member such that first head member of the first connecting device of the first panel is arranged within and free to laterally move within the first channel of the first retaining member and the second head member of the second connecting device of the first panel is arranged within and free to laterally move within the second channel of the second retaining member, wherein the second panel is disposed between the third retaining member and the fourth retaining member such that third head member of the third connecting device of the second panel is arranged within and free to laterally move within the third channel of the third retaining member and the fourth head member of the fourth connecting device of the second panel is arranged within and free to laterally move within the fourth channel of the fourth retaining member, and wherein the cap covers a gap formed between the first panel and the second panel.

2. The structural panel system of claim 1 further comprising:

a third panel having a fifth connecting device connected to a first end of the third panel and a sixth connecting device connected to an opposed second end of the third panel, the fifth connecting device having a fifth body member, a fifth arm member extending from the fifth body member, and a fifth head member extending from the fifth arm member opposite from the fifth body member, the fifth body member of the fifth connecting device being connected to the first end of the third panel, and the sixth connecting device having a sixth body member, a sixth arm member extending from the sixth body member, and a sixth head member extending from the sixth arm member opposite from the sixth body member, the sixth body member of the sixth connecting device being connected to the second end of the third panel, wherein the first retaining member has a fifth channel opposite the first channel and the second retaining member has a sixth channel opposite the second channel, and wherein the third panel is disposed between the first retaining member and the second retaining member such that fifth head member of the fifth connecting device of the third panel is arranged within and free to laterally move within the fifth channel of the first retaining member and the sixth head member of the sixth connecting device of the third panel is arranged within and free to laterally move within the sixth channel of the second retaining member.

3. The structural panel system of claim 1 wherein:

the cap includes spaced apart first channel and second channels, the second arm member of the second connecting device further includes a second foot member extending from the second arm member opposite from the second body member and the second head member, the third arm member of the third connecting device further includes a third foot member extending from the third arm member opposite from the third body member and the third head member, the second foot member sealingly engages an inner surface of the first channel of the cap, and the third foot member sealingly engages an inner surface of the second channel of the cap.

4. The structural panel system of claim 3 wherein:

the first channel and the second channel of the cap open toward the second retaining member and the third retaining member.

5. The structural panel system of claim 1, wherein:

the first panel and the second panel comprise a material selected from the group consisting of polycarbonate materials, acrylic materials, polyester materials, PVC materials, glass materials, and mixtures thereof, and the first connecting device, the second connecting device, the third connecting device, and the fourth connecting device comprise a material selected from the group consisting of polycarbonate materials, acrylic materials, polyester materials, PVC materials, and mixtures thereof.

6. The structural panel system of claim 5 wherein:

the first panel and the second panel comprise a polycarbonate material, and the first connecting device, the second connecting device, the third connecting device, and the fourth connecting device comprise a polycarbonate material.

7. The structural panel system of claim 1 wherein:

the first body member, the first arm member, and the first head member are of one-piece construction, the second body member, the second arm member, and the second head member are of one-piece construction, the third body member, the third arm member, and the third head member are of one-piece construction, and the fourth body member, the fourth arm member, and the fourth head member are of one-piece construction.

8. The structural panel system of claim 1 wherein:

the first head member, the second head member, the third head member and the fourth head member are essentially umbrella shaped.

9. A structural panel system comprising:

a first retaining structure having a channel;

a second retaining structure having a locking channel; and a panel having a first connecting device connected to a first end of the panel and a second connecting device connected to an opposed second end of the panel, the first connecting device having a first body member, a first arm member extending from the first body member, and a first head member extending from the first arm member opposite from the first body member, the first body member of the first connecting device being connected to the first end of the panel, and the second connecting device having a second body member, a second arm member extending from the second body member, and a second head member extending from the second arm member opposite from the second body member, the second body member of the second connecting device being connected to the second end of the panel, wherein the panel is disposed between the first retaining structure and the second retaining structure such that first head member of the first connecting device of the panel is free to move within the channel of the first retaining structure and the second head member of the second connecting device of the panel is locked within the locking channel of the second retaining structure.

10. The structural panel system of claim 9 wherein:

the first retaining structure and the second retaining structure are mounted on at least one support such that the channel of the first retaining structure is open toward the at least one support, and the locking channel of the second retaining structure is open toward the at least one support, and the first head member extends away from the at least one support and the second head member extends away from the at least one support.

11. The structural panel system of claim 10 wherein:

the first head member sealingly engages and surface of the channel of the first retaining structure.

12. The structural panel system of claim 10 wherein:

the first retaining structure comprises a first base member mounted to the at least one support and a first cap connected to the first base member, the first cap including the channel, and the second retaining structure comprises a second base member mounted to the at least one support and a second cap connected to the second base member, the second cap including the locking channel.

13. The structural panel system of claim 12 wherein:

a surface of the panel contacts the first base member and the first head member sealingly engages an inner surface of the channel of the first cap of the first retaining structure.

14. The structural panel system of claim 9 wherein:

the panel comprises a material selected from the group consisting of polycarbonate materials, acrylic materials, polyester materials, PVC materials, glass materials, and mixtures thereof, the first connecting device comprises a material selected from the group consisting of polycarbonate materials, acrylic materials, polyester materials, PVC materials, and mixtures thereof, and the second connecting device comprises a material selected from the group consisting of polycarbonate materials, acrylic materials, polyester materials, PVC materials, and mixtures thereof.

15. The structural panel system of claim 14 wherein:

the panel comprises a polycarbonate material, the first connecting device comprises a polycarbonate material, and the second connecting device comprises a polycarbonate material.

16. The structural panel system of claim 9 further comprising:

a third retaining structure having a looking channel; and a second panel having a third connecting device connected to a first end of the second panel and a fourth connecting device connected to an opposed second end of the second panel, the third connecting device having a third body member, a third arm member extending from the third body member, and a third head member extending from the third arm member opposite from the third body member, the third body member of the third connecting device being connected to the first end of the second panel, and the fourth connecting device having a fourth body member, a fourth arm member extending from the fourth body member, and a fourth head member extending from the fourth arm member opposite from the fourth body member, the fourth body member of the fourth connecting device being connected to the second end of the second panel, wherein the second retaining structure has a second channel, and wherein the second panel is disposed between the second retaining structure and the third retaining structure such that third head member of the third connecting device of the second panel is free to move within the second channel of the second retaining structure and the fourth head member of the fourth connecting device of the second panel is locked within the locking channel of the third retaining structure.

* * * * *